United States Patent [19]

Hancock et al.

[11] 4,270,480

[45] Jun. 2, 1981

[54] PINNED SUCTION ANCHORS

[75] Inventors: Roger H. Y. Hancock, East Kilbride; Neil Kerr, Aberdeen, both of Scotland

[73] Assignee: The Secretary of State for Industry in Her Britannic Majesty's Government of the United Kingdom of Great Britain and Northern Ireland, London, England

[21] Appl. No.: 960,719

[22] Filed: Nov. 14, 1978

[30] Foreign Application Priority Data

Nov. 14, 1977 [GB] United Kingdom ..... 47354/77

[51] Int. Cl.[3] ..... B63B 21/27

[52] U.S. Cl. ..... 114/296

[58] Field of Search ..... 114/294, 295, 296; 405/224, 227, 228, 232; 175/171; 173/163

[56] References Cited

U.S. PATENT DOCUMENTS

| | | | |
|---|---|---|---|
| 571,624 | 11/1896 | Ryan | 114/295 X |
| 3,670,686 | 6/1972 | Reynolds | 114/294 X |
| 3,832,858 | 9/1974 | Anders | 405/232 |
| 4,064,703 | 12/1977 | Pogonowski | 405/224 |

FOREIGN PATENT DOCUMENTS

| | | | |
|---|---|---|---|
| 2247377 | 5/1975 | France | 114/296 |

*Primary Examiner*—Sherman D. Basinger

*Attorney, Agent, or Firm*—Cushman, Darby & Cushman

[57] ABSTRACT

The invention concerns the use of pin or pile members in combination with a suction anchor to increase greatly the pull-out resistance of the anchor. The suction anchor acts as a base from which the pin or pile members are driven into the bed material. The pin members may be driven substantially vertically into the bed material externally of the anchor skirt or may be contained within the skirt and driven through apertures in the skirt to provide additional lateral anchorage.

13 Claims, 6 Drawing Figures

Figure 1:
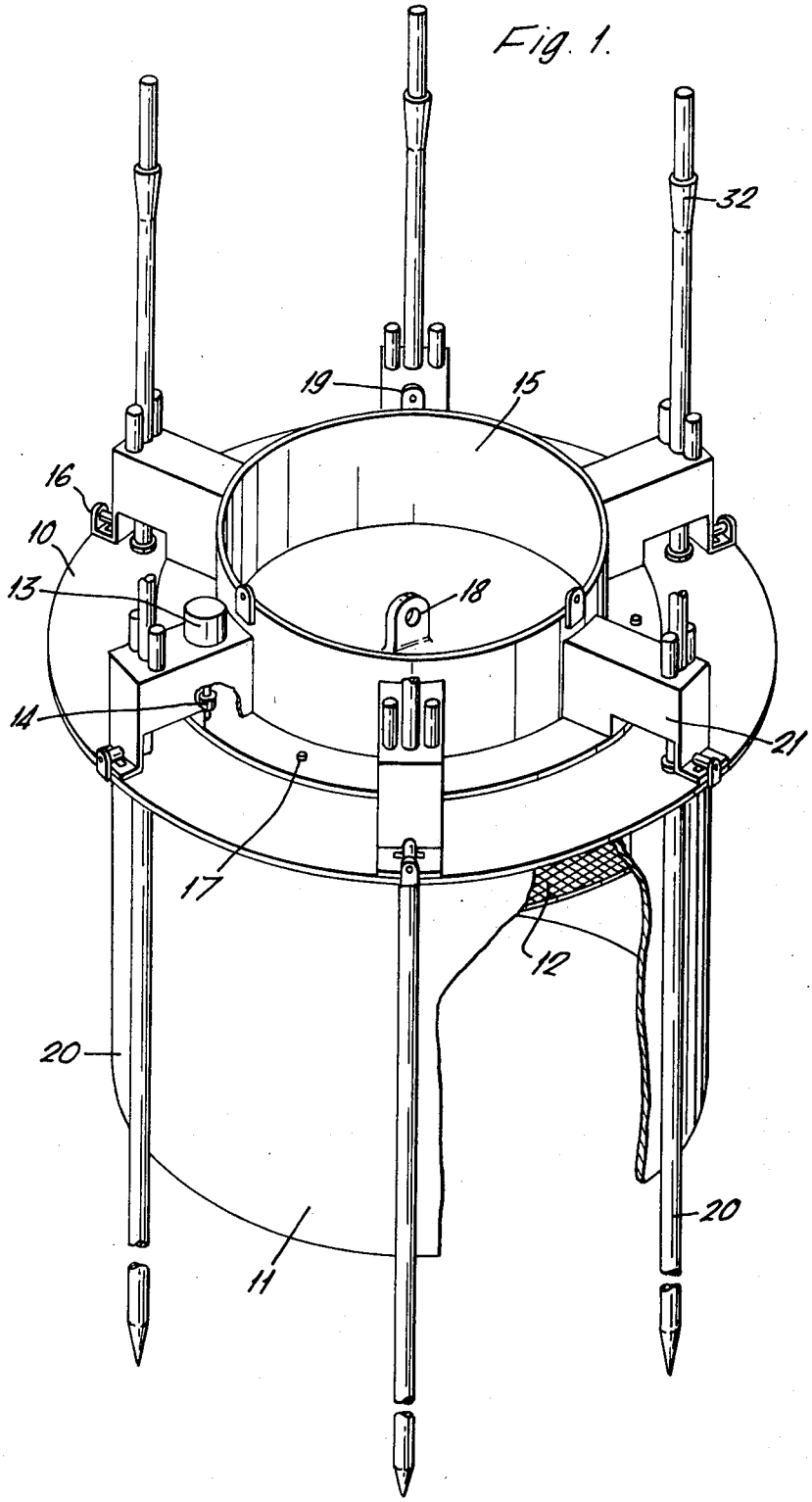

32
27
28
III
III
24
25
23
22a
22
29
26
31
26
30
15
20
10

PINNED SUCTION ANCHORS

This invention relates to anchors and in particular to suction anchors.

Suction anchors are well known and comprise, conventionally, a top plate, a depending skirt-like member and a pump. In use the anchor is lowered to the sea bed whereafter the pump suction generates a region of low pressure within the skirt. This low pressure together with the hydrostatic pressure exerted on the top plate creates a pressure differential which acts to urge the skirt into the bed material. The anchor is fully established when the top plate is resting on the bed material.

According to the present invention a suction anchor having a top plate and a skirt member depending therefrom includes at least one pin or pile member operative in use to be driven into the bed material to increase the pull-out resistance of the anchor.

In one embodiment of the invention there are provided a plurality of pin members located relative to the anchor top plate and arranged to be driven through the top plate.

The pin members may be positioned in spaced apart relationship around the circumferential region of the anchor top plate and arranged to penetrate the bed material externally of the skirt portion of the anchor.

Preferably, although not necessarily, the pin members are arranged to be driven vertically or substantially vertically into the bed material.

Engagement means are provided on the pin members whereby the pins engage with the anchor top plate at the completion of burial.

Conveniently the pin members are in use driven into the bed material by drive means located on the anchor top plate. Advantageously the drive means are mounted on the radial flange of a flanged drum which is releasably secured to the anchor top plate.

In one aspect of the first embodiment of the invention the pin members are driven into the bed material without intentional rotation and the drive means may comprise a cam-grip clutch arrangement in which a series of eccentrically mounted cams with serrated gripping faces are arranged around the pin member such that upon movement of the cams in one direction (upwardly) free non-gripping motion is possible but whereupon movement in the other direction (downwardly) the serrated cam faces grip the pin member and drive it into the bed material. In an alternative arrangement there may be provided hydraulic grips arranged normally of the pile member and operative to alternately securely grip and release the pin member in accordance with a vertical reciprocating motion of the arrangement whereby the pin member is driven into the bed material.

In a second aspect of the first embodiment of the invention the pin members are in the form of screw piles having augers at their lower ends. The screw piles are driven into the bed material by means of conventional "Kelly Tables" powered by drive motors, preferably hydraulic, mounted on the releasable flanged drum.

In a second embodiment of the invention the pin member is housed initially within the skirt member and is adapted to be driven through a suitable aperture in the skirt into the bed material after the initial suction stage of the anchoring sequence has been completed.

Preferably a series of pin members are arranged within the skirt in a substantially horizontal plane, each pin capable of being driven outwardly of the skirt in a tangential direction. The pin members may be telescopic or may operate on a piston/cylinder principle. The pin members are conveniently powered by hydraulic means.

Also according to the invention there is provided a means of establishing an anchorage in a bed material comprising the establishment of an initial anchorage by conventional suction anchor techniques whereafter pin or pile members associated with the suction anchor are driven into the bed material to further secure the suction anchor to the bed material.

Figure 2:
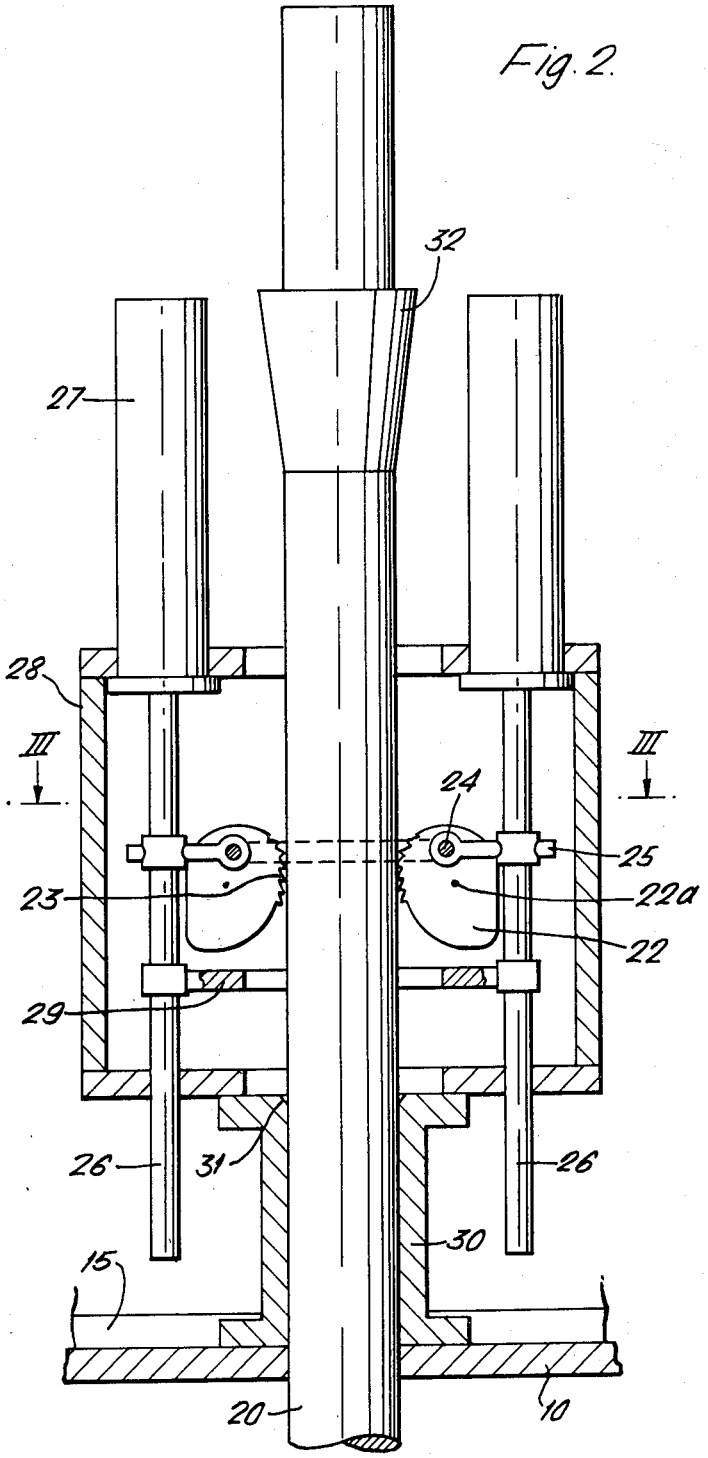
Figure 3:
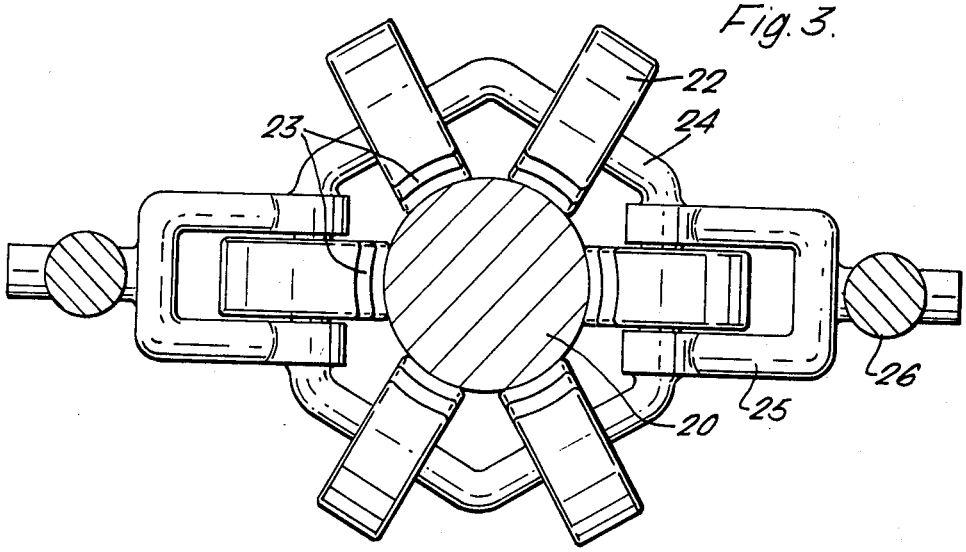
Figure 4:
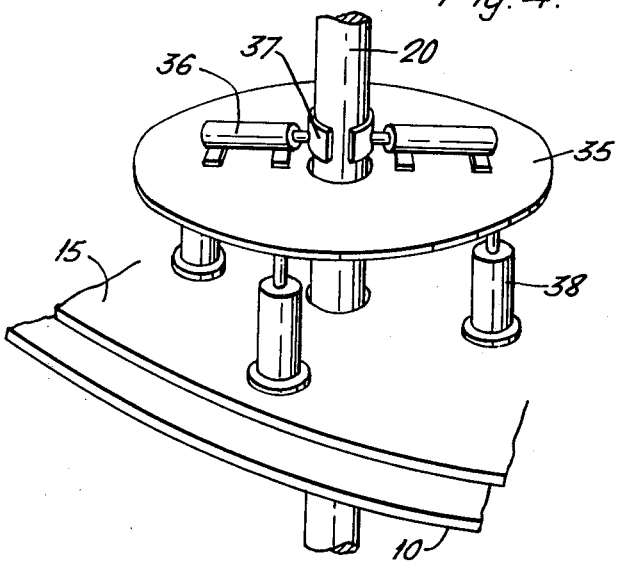
Figure 5:
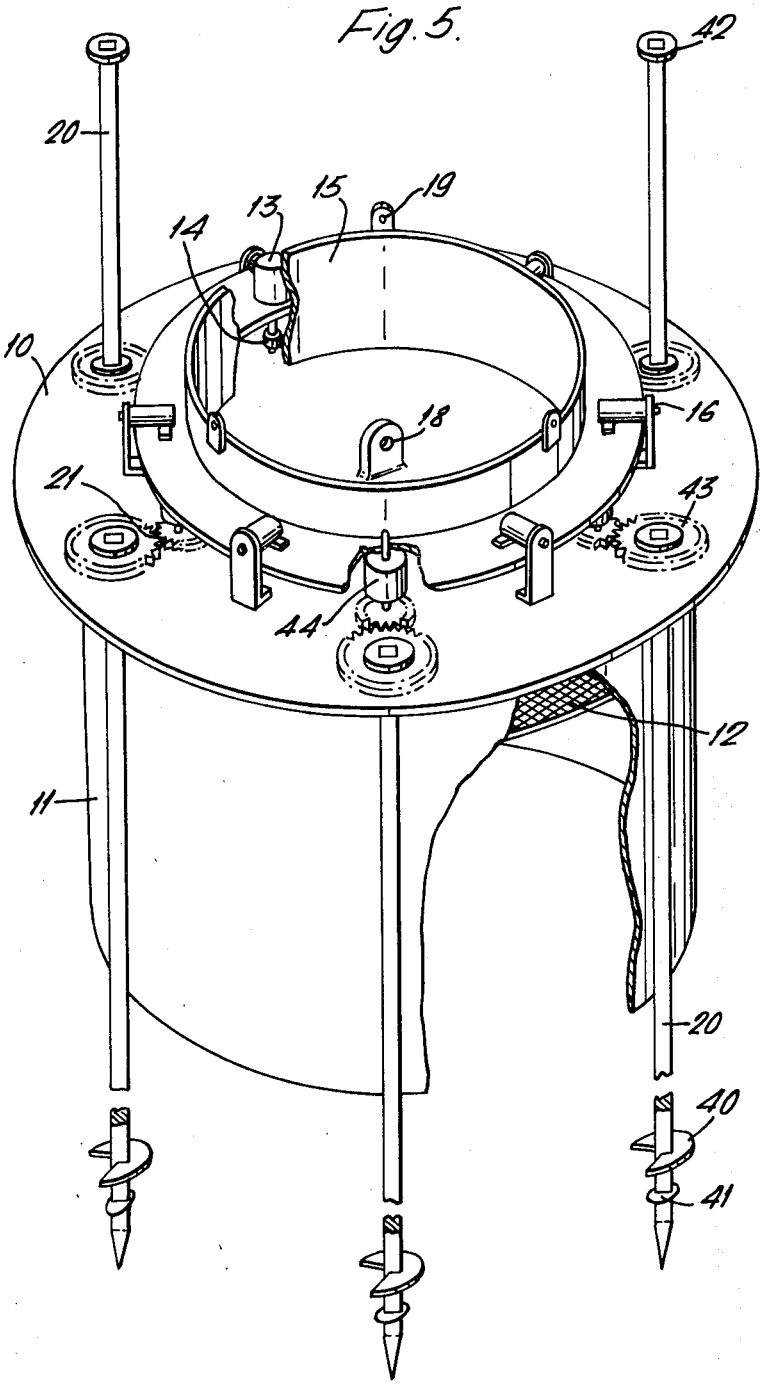
Figure 6:
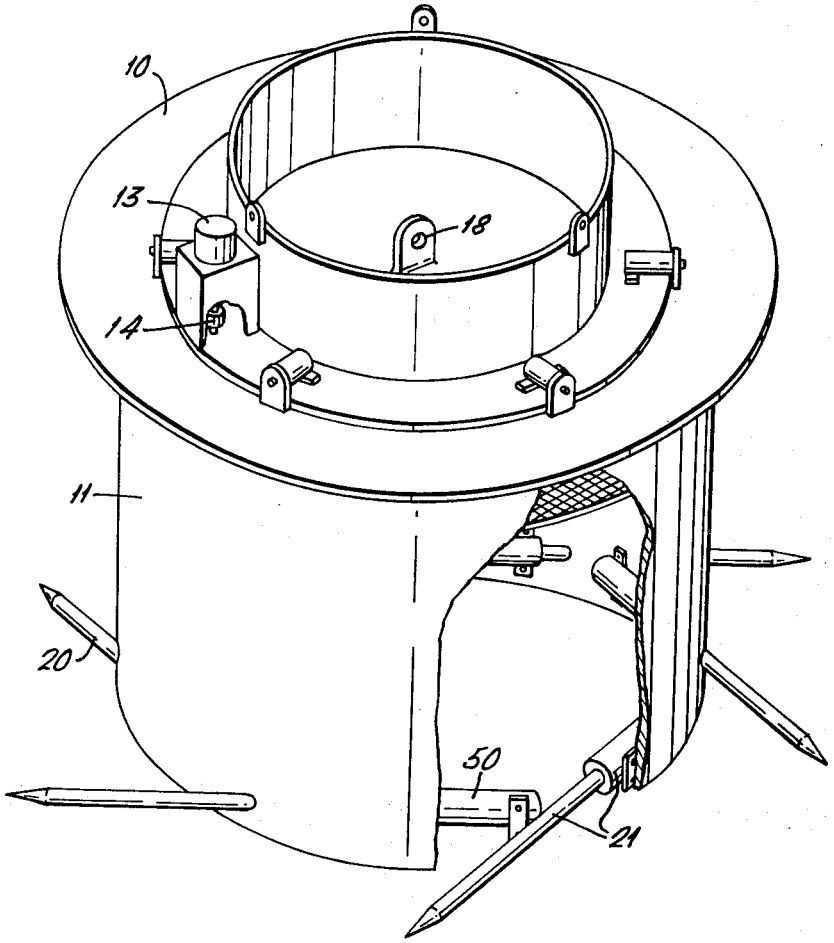

Various embodiments of the invention will now be described by way of example only with reference to the accompanying drawings in which:

FIG. 1 illustrates an anchor of a first embodiment of the invention incorporating simple pin or pile members, FIG. 2 is a sectional elevation on the centre line of a pin member of FIG. 1 illustrating a first pin driving mechanism, FIG. 3 is a section on lines III—III of FIG. 2, FIG. 4 is a perspective view of an alternative pin drive mechanism, FIG. 5 illustrates a further anchor of the first embodiment of the invention incorporating screw pins and FIG. 6 illustrates an anchor in accordance with a second embodiment of the invention.

Referring initially to FIGS. 1, 5 and 6 the suction anchor of the invention comprises a top plate 10, a cylindrical skirt member 11 depending therefrom, a porous member 12 and a pump 13. The pump 13 is in fluid communication with the underside of the top plate 10 within the skirt member 11 via a quick release coupling 14. The porous member 12 acts a prevent the ingress of large solid particles which might otherwise clog the pump 13.

A flanged drum 15 is releasably secured to the top plate 10 by means of hydraulically operated pin and lug attachments 16, the drum 15 being positioned on locating dowels 17 on the top plate 10. A main anchor load chain or hawser attachment lug 18 is provided in the central region of the top plate 10 and secondary attachment lugs 19 are provided on the flanged drum 15 for use in its removal after burial of the anchor. The main anchor load chain or hawser may conveniently be coiled inside the flanged drum 15 before burial thereby increasing the total mass of the anchor and assisting its burial.

In use the suction anchor is lowered to the bed material and suction from the pump 13 generates a zone of low pressure within the skirt member 11. This low pressure and the hydrostatic pressure exerted on the top plate 10 results in a pressure differential being formed across the top plate 10 which then acts to cause the skirt member 11 to penetrate into the bed material to a position in which the top plate 10 rests on the bed material.

Once burial of the suction anchor to the extent described has been completed pin or pile members 20 associated with the anchor are driven into the bed material by drive means 21 to establish an increased resistance to pull-out forces.

Considering now specifically a first embodiment of the invention as shown in FIGS. 1, 2, 3 and 4 the pin members 20 extend vertically downwardly through the top plate 10 externally of the skirt member 11. The pin member drive means 21 (FIG. 1) can be in the form shown in either FIGS. 2 and 3 or 4 or of any other similar design.

FIGS. 2 and 3 show a cam-grip clutch mechanism for driving a pin member 20. The drive means 21 (see FIG. 1) includes six cams 22 each having a serrated gripping face 23 arranged radially around the pin member 20 and suspended from a collar member 24. The collar member 24 includes collar arms 25 which pass freely through bushed holes in the ram rods 26 of two hydraulic rams 27 mounted on a support frame 28 attached to the flange of the flanged drum 15. The ram rods 26 are connected together by means of a cross member 29.

The pin member 20 is located by means of a guide 30 attached to the top plate 10 which is provided with a slight chamfer 31 against which the tapered head 32 of the pin member 20 bears when it has been driven fully home. Clearange holes are provided in the support frame 28 and the ram cross member 29 to allow the tapered head 32 to pass therethrough and to allow for subsequent removal of the complete drive means 21 as part of the flanged drum 15.

The design and mounting of the cams 22 is such that with the serrated gripping face 23 in engagement with the pin member 20 the centre of gravity 22*a* of each cam is on the side of the cam mounting point remote from the pin member 20. This eccentricity between the centre of gravity 22*a* and the point of suspension of the cam 22 tends to swing the cam 22 towards the pin member 20.

The pin driving mechanism operates on a simple reciprocating motion: a downward movement of the ram rods 26 results in the serrated faces 23 of the cams 22 gripping the pin member 20 and driving it into the bed material. A small upward force will then release the cams 22 from the pin member 20 and allow them to be returned to their datum position. The cam 22 profiles are so designed to allow upward passage around the maximum diameter of the tapered pin head 32 whilst gripping the head 32 on the downward stroke. The pin member 20 can therefore be driven home until the tapered head 32 bears on the chamfer 31 of the guide 30.

An alternative pin member drive means 21 is shown in FIG. 4 and operates hydraulically. A plate member 35 having a central clearance aperture for passage of the pin member 20 supports horizontally mounted hydraulic rams 36 controlling serrated clamps 37 by which the pin member 20 can be securely gripped. The plate member 35, and hydraulic ram 36/clamp 37 assembly, is movable longitudinally of the pin member 20 by means of vertically located hydraulic rams 38 mounted on the flange of the flanged drum 15 (see FIG. 1). The sequence of operations for driving the pin member 20 into the bed material is as follows: Firstly the hydraulic rams 36 cause the serrated clamps 37 to grip the pin member 20. The plate member 35, under action of the hydraulic rams 38, is then subjected to a downward movement driving the pin member 20 into the bed material. At the completion of the downward stroke the hydraulic rams 36 withdraw the serrated clamps 37 whereafter the plate member 35 is raised to its datum position. This cycle of events is repeated until the pin member 20 is driven fully home.

It should be noted that although the pin member drive means 21 of FIGS. 2, 3 and 4 has been described for round pin members, other sections such as rectangular or "H" section can be similarly driven.

FIG. 5 shows a basic suction anchor of the kind described in which the pin members 20 are screw pins of square section including main 40 and pilot 41 augers at their lower end. The pin members 20 also have a head member 42 which bears against the top plate 10 when the pin member 20 has been fully driven into the bed material. The screw pin members 20 are driven into the bed material by conventional "Kelly Tables" 43 powered by hydraulic motors 44. As with the designs of FIGS. 1, 2, 3 and 4 the drive means 21 (in this case the motor 44 and associated "Kelly Table" drive sprocket) are mounted on the flange of the detachable drum 15.

FIG. 6 shows a second embodiment of the invention in which the pin members 20 are driven horizontally through the skirt 11 of the suction anchor once it is fully established in the bed material. The pin member drive means 21 are hydraulic rams 50 in which the pin members 20 constitute the rod members. The rod/ram assemblies are mounted in a horizontal plane, each forming a chord of the skirt member 11. When the suction anchor burial has been completed the pin members 20 are driven through clearance holes in skirt 11 into the bed material. Although the hydraulic connection to the rams 50 is not shown it would incorporate a quick release coupling in the region of the flanged drum 15 to facilitate removal after use.

Once burial of the anchor of the invention has been completed with the pin members 20 firmly established in the bed material, the pins of the pin and lug attachments 16 are withdrawn and the drum 15 together with the pump 13 and pin member drive means 21 recovered.

It will be readily appreciated by the artisan that in addition to the embodiments described above many other designs embodying the principle of the invention are possible whereby a suction anchor is used as a platform from which pin or pile members might be driven into the bed material to increase the pull-out resistance of the anchor.

We claim:

1. A suction anchor for establishing an anchorage in a bed material comprising a top plate, a skirt member depending from said top plate and having a lower edge engageable with said bed material to enclose an internal space, suction means for embedding said skirt member in said bed material by evacuating said space, and means for increasing the pull-out resistance of said anchor including a plurality of pin members positioned in spaced apart relation around the circumferential region of said top plate, pin drive means mounted on said top plate in fixed spacial relationship thereto and engageable with said plurality of pin members, for driving said plurality of pin members through said top plate into the bed material externally of said skirt member, and engagement means for holding said plurality of pin members to said top plate when said plurality of pin members have been driven into said bed material.

2. A suction anchor as claimed in claim 1 having a radially flanged drum releasably secured to the anchor top plate and in which the drive means are mounted on the radial flange of the flanged drum.

3. A suction anchor as claimed in claim 2 in which the drive means includes hydraulic grips arranged normally of said plurality of pin members and operative to alternately securely grip and release said plurality of pin members in accordance with a vertical reciprocating motion of said grips arrangement whereby the said plurality of pin members are driven into the bed material.

4. A suction anchor as in claim 1 wherein said top plate has a plurality of interior enclosed circumferential edges defining a plurality of holes for receiving said pin members and said engagement means comprises tapered heads formed on said pin members for engaging said circumferential edges to hold said pin members when said pin members have been driven into said bed material.

5. A suction anchor as in claim 4 wherein said circumferential edges are chamferred.

6. A suction anchor for establishing an anchorage in a bed material comprising a top plate, a skirt member depending from said top plate and having a lower edge engageable with said bed material to enclose an internal space, suction means for embedding said skirt in said bed material by evacuating said space, means for increasing the pull-out resistance of said anchor including pin drive means for driving at least one pin member into the bed material wherein said at least one pin member is housed within said skirt member, said skirt member having an aperture formed therein, said pin drive means further comprising means for driving said pin member through said aperture into the bed material after said skirt member is embedded in said bed material.

7. A suction anchor as claimed in claim 6 including a series of pin members arranged within the skirt in a substantially horizontal plane, and means arranged within the skirt for driving said series of pin members outwardly of the skirt in a tangential direction.

8. A suction anchor as claimed in claim 7 in which each pin member is of telescopic construction.

9. A suction anchor as claimed in claim 7 in which each pin member comprises a cylinder member and a piston member fitted for reciprocal movement in said cylinder member.

10. A suction anchor for establishing anchorage in a bed material comprising a top plate, a skirt member depending from said top plate and having a lower edge engageable with said bed material to enclose an internal space, suction means for embedding said skirt member in said bed material by evacuating said space, and means for increasing the pull-out resistance of said anchor including a plurality of pin members located relative to said top plate, and pin drive means mounted on said top plate in fixed spacial relationship thereto and engageable with said plurality of pin members for driving said plurality of pin members through said top plate into said bed material.

11. A suction anchor as claimed in claim 10 having a radially flanged drum releasably secured to the anchor top plate, the drive means being mounted on the radial flange of the flanged drum.

12. A suction anchor as claimed in claim 1 or claim 2 wherein said plurality of pin members are in the form of screw piles having augers at their lower ends.

13. A suction anchor as claimed in claim 1 or claim 2 or claim 11 in which the drive means includes cam-grip clutch arrangements having series of eccentrically mounted cams with serrated gripping faces arranged around each of said plurality of pin members such that upon movement of the cams in one direction (upwardly) free non-gripping motion is possible but whereupon movement in the other direction (downwardly) the serrated cam faces grip said plurality of pin members and cause them to be driven into the bed material.

* * * * *